US005820330A

United States Patent [19]

Focke et al.

[11] Patent Number: 5,820,330

[45] Date of Patent: Oct. 13, 1998

[54] APPARATUS FOR THE RECEPTION AND TRANSPORT OF REELS OF PACKAGING MATERIAL

[75] Inventors: Heinz Focke; Johann Köster, both of Verden; Hugo Mutschall, Kirchlinteln, all of Germany

[73] Assignee: Focke & Co. (GmbH & Co.), Verden, Germany

[21] Appl. No.: 614,510

[22] Filed: Mar. 13, 1996

[30] Foreign Application Priority Data

Mar. 13, 1995 [DE] Germany ..... 195 08 581.7

[51] Int. Cl.[6] ..... B66F 9/00

[52] U.S. Cl. ..... 414/427; 414/911; 187/231; 187/229; 187/234; 187/236; 108/55.3

[58] Field of Search ..... 414/426, 427, 414/684, 911; 187/231, 229, 226, 234, 236, 237, 238, 230, 244; 212/250; 254/2 R, 4 R; 108/55.3, 52.1

[56] References Cited

U.S. PATENT DOCUMENTS

| | | | |
|---|---|---|---|
| 2,803,363 | 8/1957 | Hutchinson | 108/55.3 X |
| 3,052,323 | 9/1962 | Hopfeld | 187/234 X |
| 3,145,859 | 8/1964 | Barosko | 414/427 |
| 3,472,363 | 10/1969 | Rustin, Jr. et al. | 108/55.3 X |
| 3,749,265 | 7/1973 | Smith, Jr. | 414/427 |
| 4,050,597 | 9/1977 | Hawkins | 414/427 |
| 4,421,209 | 12/1983 | Vermette et al. | 187/9 |
| 4,502,568 | 3/1985 | Lebre | 187/9 R |
| 4,771,531 | 9/1988 | Asher | 414/428 X |
| 4,854,422 | 8/1989 | Kawada et al. | 187/234 X |
| 4,987,976 | 1/1991 | Daugherty | 187/11 |
| 5,274,984 | 1/1994 | Fukuda | 414/911 X |
| 5,340,260 | 8/1994 | Turra et al. | 414/911 X |
| 5,362,194 | 11/1994 | Kassebaum | 414/427 |
| 5,413,054 | 5/1995 | Collins | 108/55.3 |
| 5,490,756 | 2/1996 | Reichart et al. | 414/911 X |

FOREIGN PATENT DOCUMENTS

| | | |
|---|---|---|
| 0029384 | 5/1981 | European Pat. Off. . |
| 1934336 | 1/1971 | Germany . |
| 7212492 | 6/1974 | Germany . |
| 2428883 | 1/1975 | Germany . |
| 3739012 | 6/1989 | Germany . |
| 9408400 | 9/1994 | Germany . |
| 9315976 | 3/1995 | Germany . |
| 979020 | 1/1965 | United Kingdom . |
| 1296299 | 11/1972 | United Kingdom . |
| 2231026 | 11/1990 | United Kingdom . |
| 2257684 | 1/1993 | United Kingdom . |

*Primary Examiner*—Stephen T. Gordon
*Attorney, Agent, or Firm*—Abelman, Frayne & Schwab

[57] ABSTRACT

A transport appliance (10) to be actuated manually serves for handling large-volume reels (11) of packaging material. This transport appliance (10) is equipped with a lifting mechanism (23) which in each case grasps a reel (11) with vertical positioning, specifically by means of carrier rods (24, 25) on the cylindrical circumferential surface. The lifting mechanism (23) is operated hydraulically by means of a vertical hydraulic cylinder (33) which is supplied with oil via a hydraulic pump (38) to be operated by hand, in order to raise the carrier rods (24, 25) together with the reel (11).

6 Claims, 6 Drawing Sheets

APPARATUS FOR THE RECEPTION AND TRANSPORT OF REELS OF PACKAGING MATERIAL

DESCRIPTION

Figure 1:
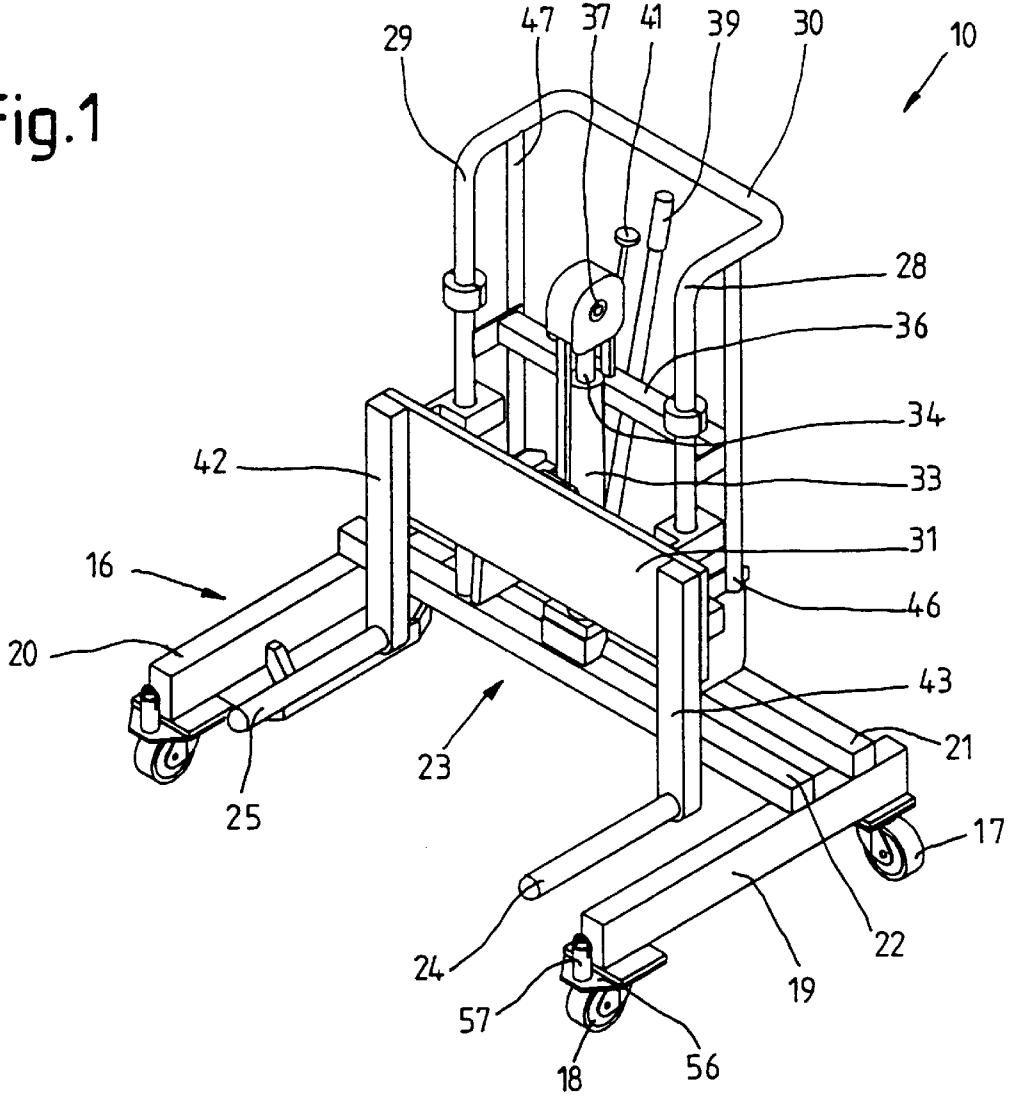

The invention relates to an apparatus for the reception and transport of rolls of wound packaging material—so-called reels (11)—in connection with packaging and other processing machines (14), with a transport appliance (10) which consists of an undercarriage (16) having running rollers (17, 18) or wheels for mobility and having two raisable and lowerable carrier rods (24, 25) for at least one reel (11) which are arranged on the undercarriage (16), the reels (11) kept ready in a vertical plane with an essentially horizontally directed axis and resting on a base being capable of being grasped and raised by the carrier rods (24, 25).

The supply of packaging machines for cigarettes, but also of cigarette-producing machines processing web-like material, requires special measures on account of the high performance of the machines and the considerable consumption of material. A number of proposals for the transport of reels of packaging material from a store to the consumption points, that is to say the packaging machines, are known. The latter are conventionally provided with at least one horizontally directed working journal for receiving the reel.

It has recently been proposed to use particularly large reels which have a stock of material for one working shift of the factory. Reels of this type cannot be controlled by conventional fully automatic transport systems, for example overhead tracks.

The apparatus on which the invention is based is, therefore, to propose measures for an expedient handling of large-volume heavyweight reels.

To achieve this object, the apparatus according to the invention has the following features:

a) the reels (11) rest with their circumferential surface on a pallet (12) as a base, b) the undercarriage (16) of U-shaped plan consists of two lateral longitudinal spars (19, 20) having running rollers (17, 18) at the ends and of at least one eccentrically arranged transverse connection composed of at least one transverse spar (21, 22), c) the spacing of the longitudinal spars (19, 20) is selected in such a way that these extend on both sides of the pallet (12), d) the raisable and lowerable carrier rods (24, 25) are located, for receiving the reel (11), above the pallet (12) and extend between the longitudinal spars (19, 20), so that they can grasp the reel (11) on its cylindrical circumferential surface.

The main part of the apparatus according to the invention is therefore a mobile transport appliance for grasping and raising reels, which is adapted in shape and dimensions to the dimensions of the pallet. The transport appliance is actuated manually and moved by hand. For this purpose, an undercarriage is equipped with running rollers. According to the invention, a lifting mechanism is arranged on the undercarriage for the purpose of grasping and raising reels.

Furthermore, an integral part of the apparatus according to the invention is a pallet designed in a special way. This is provided with supporting battens on the top side which are adapted to the shape and size of the reels. A plurality of reels can thus rest next to one another on the pallet and are held positively. The reels are picked up in succession from the pallet by the transport appliance and transported to the packaging machine.

Further particulars of the transport appliance according to the invention and of the pallet are explained in more detail below by means of the drawings.

Figure 2:
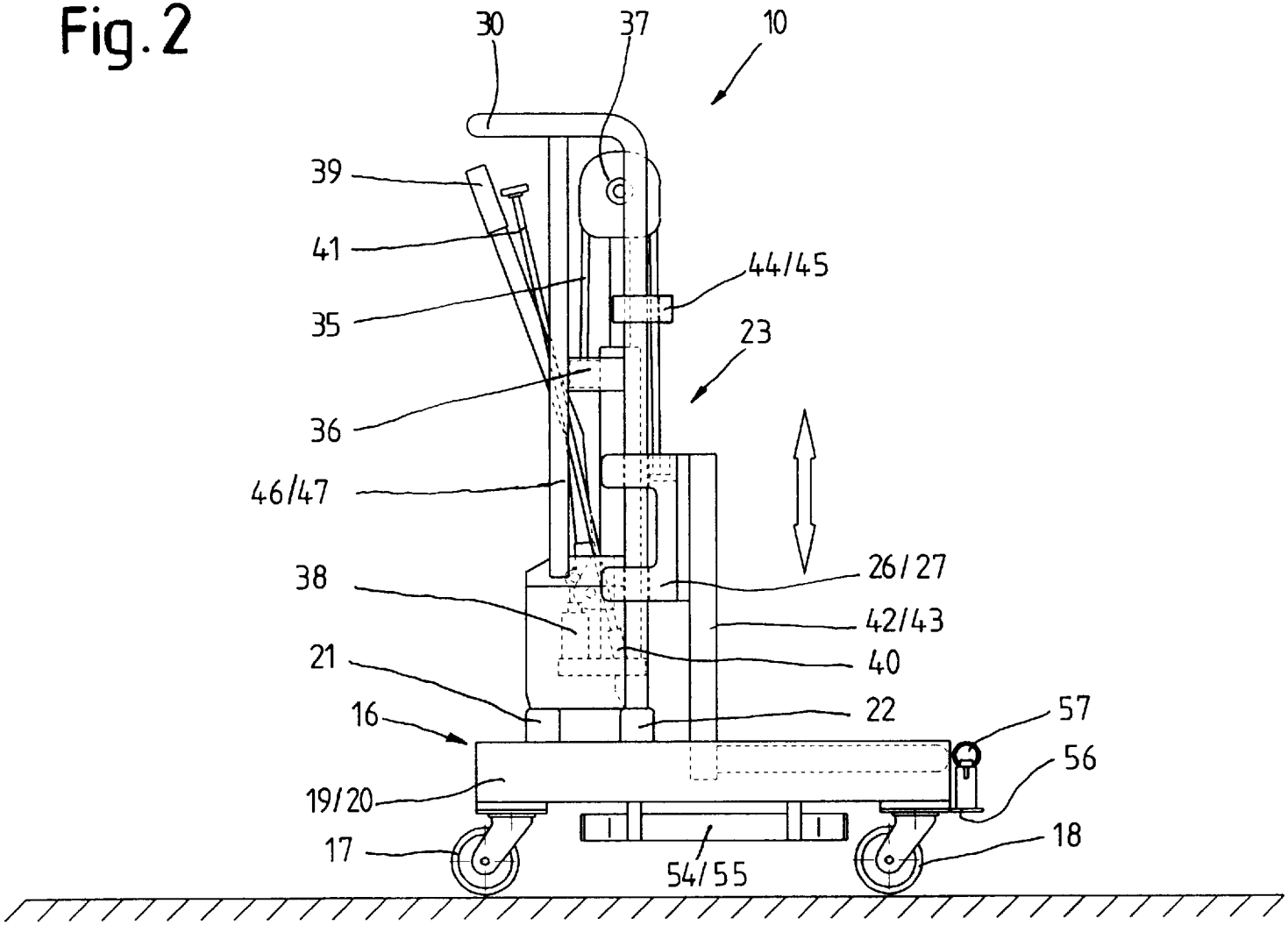
Figure 3:
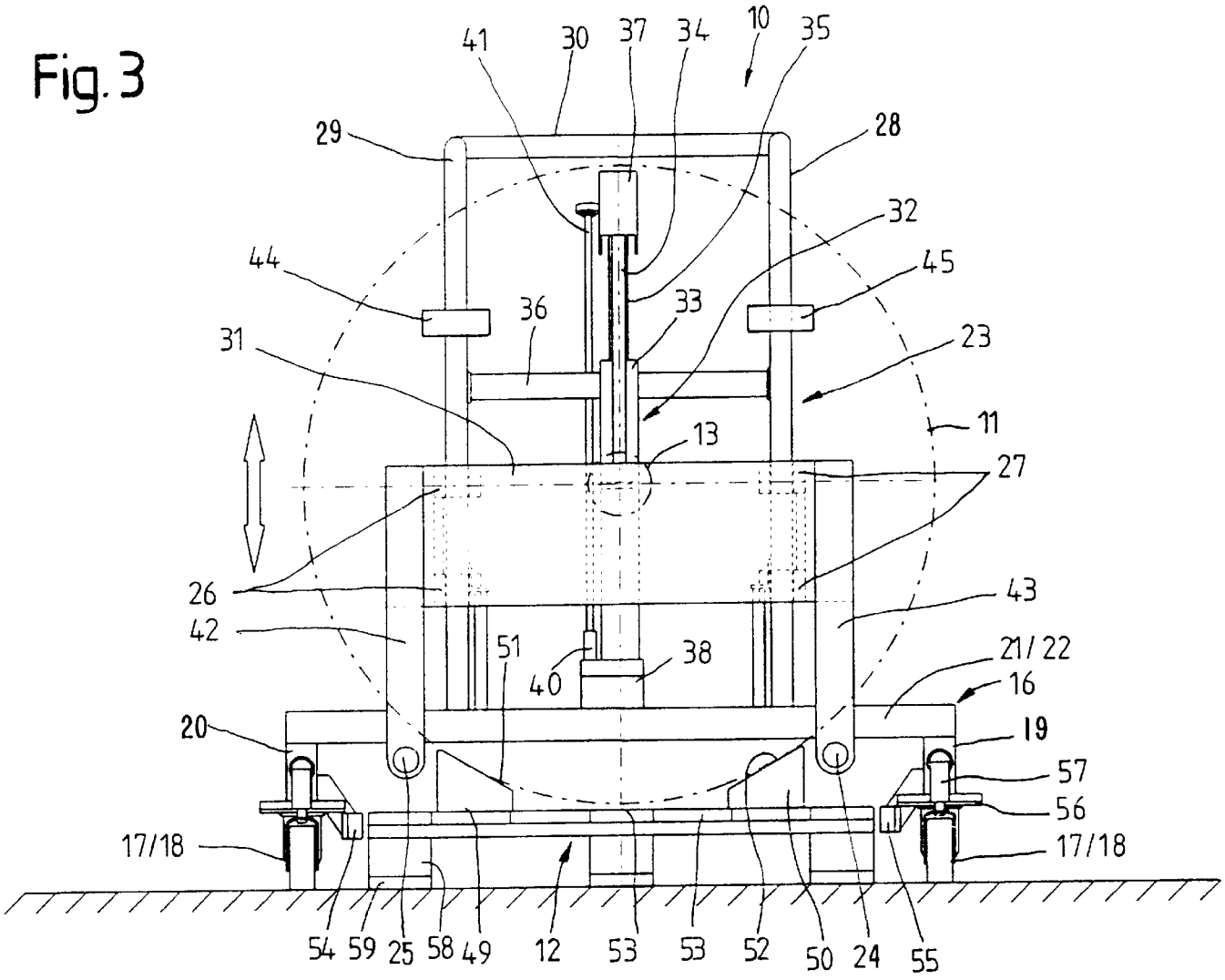
Figure 4:
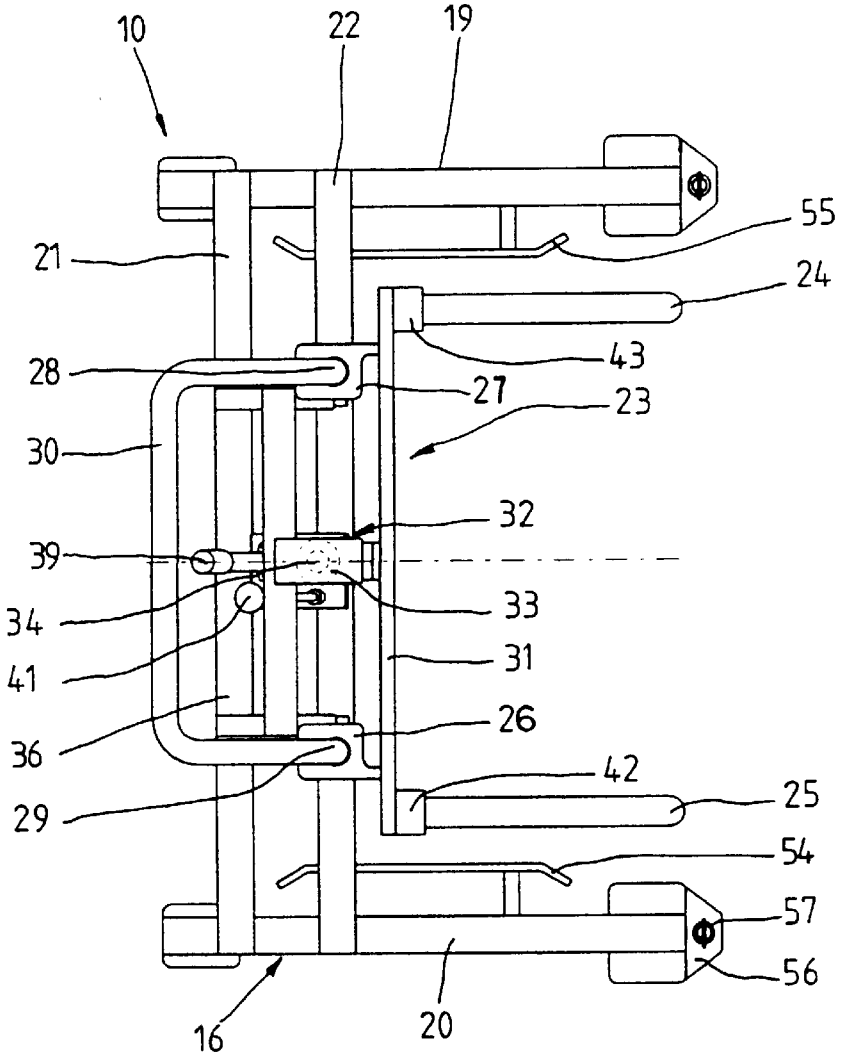
Figure 5:
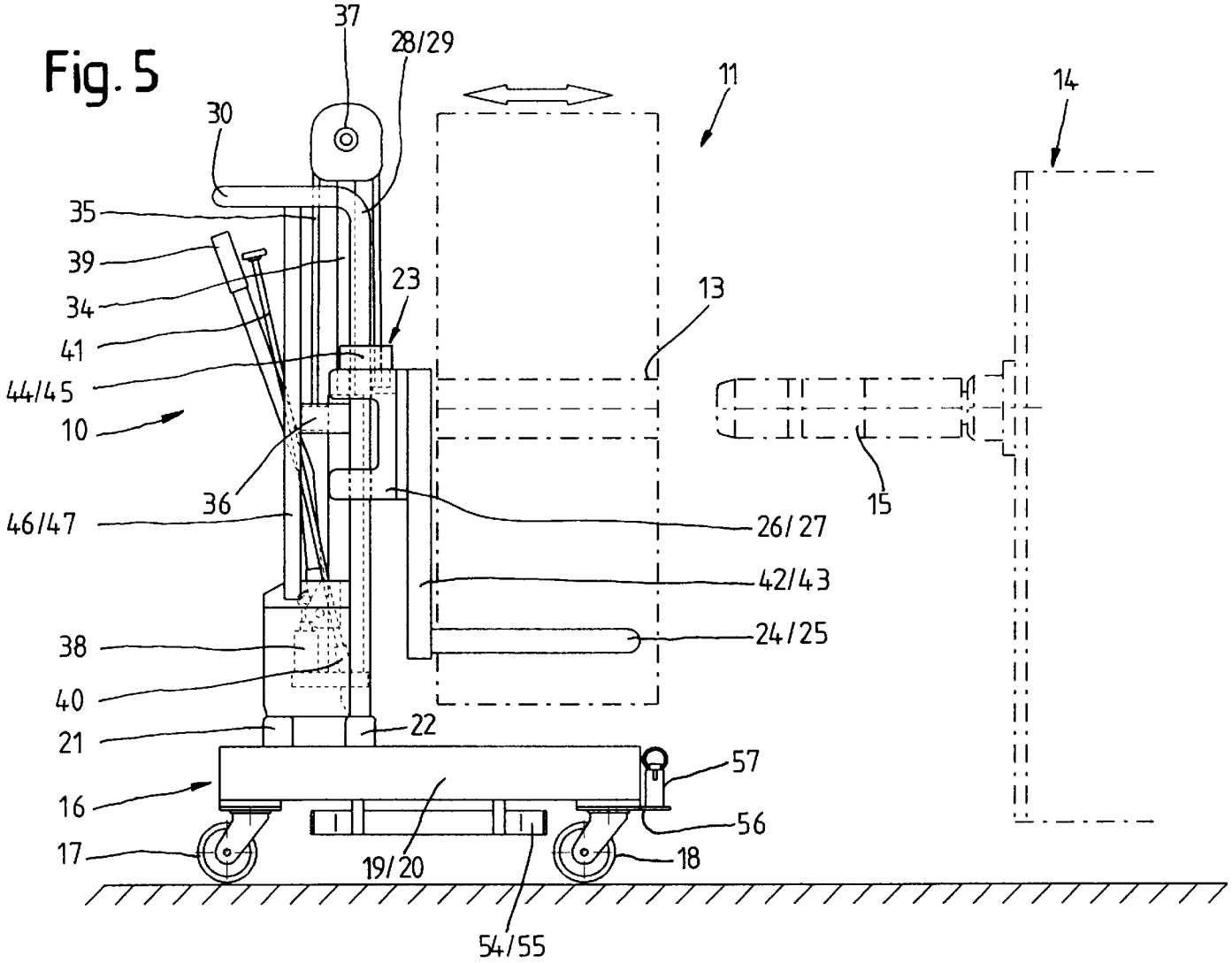
Figure 6:
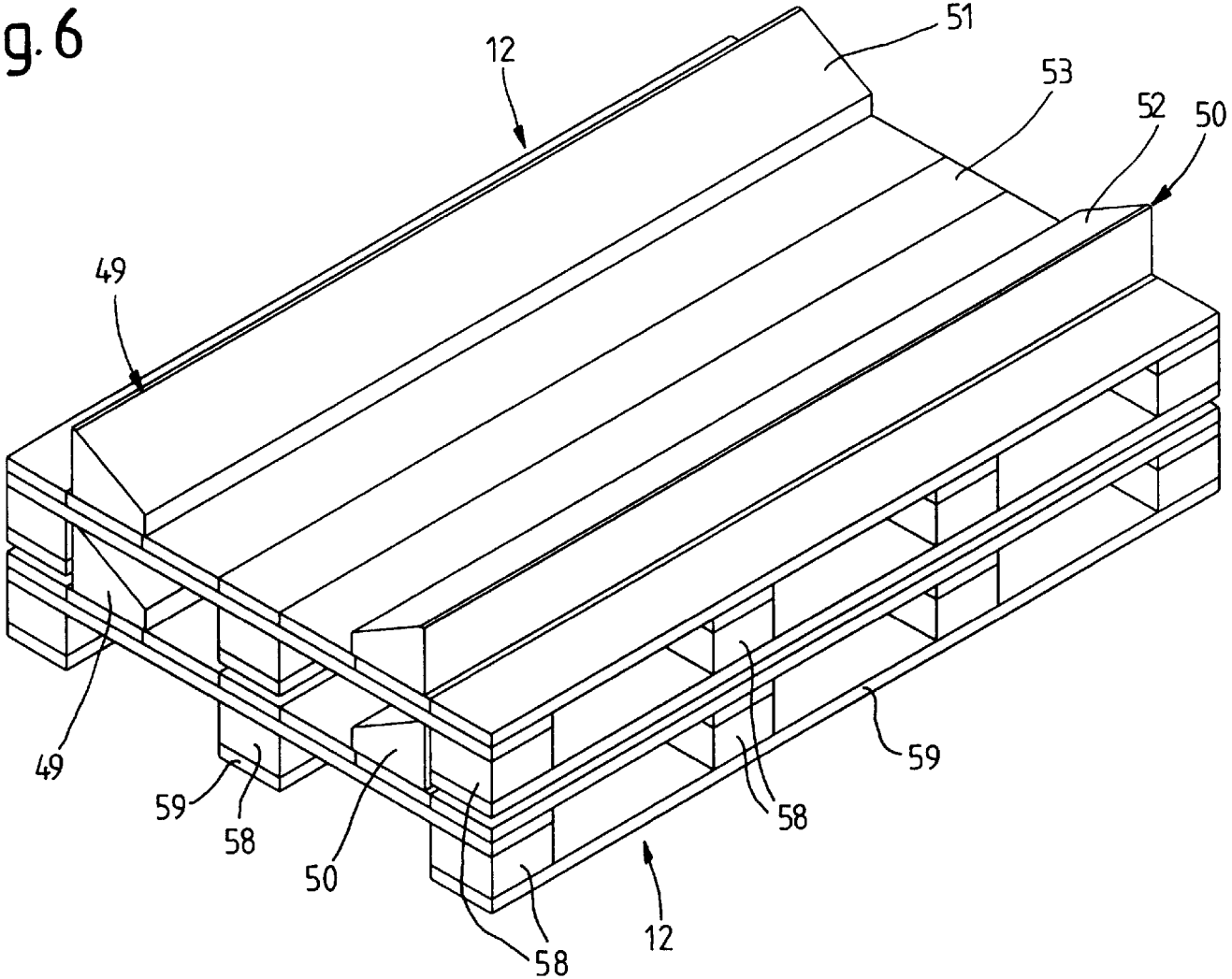

In these:

FIG. 1 shows a perspective representation of a transport appliance for reels, FIG. 2 shows a side view of the transport appliance according to FIG. 1, FIG. 3 shows a front view of the transport appliance, with a reel received, FIG. 4 shows a top view of the transport appliance, FIG. 5 shows a side view similar to that of FIG. 2 during the transport of a reel or during the transfer of the latter onto a working journal, FIG. 6 shows a perspective representation of special pallets.

The drawings show, on the one hand, an exemplary embodiment of a transport appliance 10 for reels 11 and, on the other hand, a special pallet 12 for the storage and transport of the reels 11.

The reels 11 are large-volume rolls of wound material webs, particularly composed of packaging material, such as paper, foil or the like. The reels 11 have a comparatively large diameter and therefore a high dead weight. It is customary for such reels 11 to have a central orifice 13. In the exemplary embodiment shown, the reel 11 is pushed with this orifice 13 onto a carrier device of a packaging machine 14 or of another processing machine, namely onto a working journal 15 projecting on one side.

The transport appliance 10 is designed for manual handling. An undercarriage 16 is provided on the underside with (four) running rollers 17 and 18, specifically with two at the rear and two at the front in each case. The running rollers 17, 18 are designed as trestle rollers, that is to say are mounted rotatably about a vertical axis.

The undercarriage 16 is of essentially U-shaped design in plan, with an open front side. Two parallel longitudinal spars 19, 20 extend in the longitudinal direction. The four running rollers 17, 18 are attached to the underside of these. The longitudinal spars 19, 20 are connected to one another eccentrically, namely in the rear region, to form a U-shaped frame. In the present instance, two parallel transverse spars 21, 22 are fastened to the top side of the longitudinal spars 19, 20.

Mounted on the undercarriage 16 thus formed, namely on the transverse spars 21, 22, is a lifting mechanism 23. This is equipped with a carrier member, movable up and down, for grasping a reel 11. In the present exemplary embodiment, the carrier member comprises two parallel, essentially horizontally directed carrier rods 24, 25 arranged spaced from one another. These are arranged on the lifting mechanism 23 so as to project or overhang on one side. The carrier rods 24, 25 extend between the longitudinal spars 19, 20 of the undercarriage 16. The relative position is such that the two carrier rods 24, 25 can grasp a reel 11 on the cylindrical circumferential surface. The reel 11 rests, in this case, on the carrier rods 24, 25 (FIG. 5).

The carrier rods 24, 25 are movable up and down as a unit. For this purpose, they can be moved together with a carrier body 26, 27 on a vertical guide, in the present instance on two vertical guide rods 28, 29 arranged spaced from one another. These are integrally connected to one another at the upper end to form a transversely directed handle 30 shaped towards the rear side. When the transport appliance 10 is being moved, the operator can grasp the handle 30.

The carrier rods 24, 25 are connected to one another by means of a transversely directed horizontal crosspiece 31. In the present instance, the carrier bodies 26, 27 are connected to the crosspiece 31. Furthermore, the crosspiece 31 is connected to a lifting device for moving the carrier rods 24, 25 up and down.

In the present instance, the lifting mechanism 23 is operated hydraulically. For this purpose, a hydraulic assembly 32 is installed on the undercarriage 16, specifically on the transverse spars 21, 22. The hydraulic assembly 32 is arranged in the longitudinal mid-plane of the transport appliance. A vertical hydraulic cylinder actuates the carrier rods 24, 25 with the effect of an upward movement by means of an extendable and retractable piston rod 34. Here, the piston rod 34 is not connected directly to the carrier rods 24, 25 or the crosspiece 31. Instead, the lifting force is transmitted via a finite pull member, namely via a chain 35. The latter is fixedly anchored at one end, namely on a cross-member 36 which extends approximately at mid-height and which connects the vertical guide rods 28, 29 to one another in a stabilizing manner. The other end of the chain 35 is connected to the carrier rods 24, 25 or centrally to the transversely directed crosspiece 31. The chain 35 is guided over an upper deflecting pulley 37 which is arranged at the upper end of the piston rod 34. As a result of the upward-directed extension of the piston rod 34, therefore, the deflecting pulley 37 is raised. The chain strand connected to the crosspiece 31 is thereby likewise moved upwards, at the same time taking up the crosspiece 31 and consequently the carrier rods 24, 25. In the representations made in the drawings, the deflecting pulley 37 is concealed by a cladding.

The lifting mechanism 23 is actuated semimanually. The hydraulic cylinder 33 is assigned a hydraulic pump 38. The latter is actuated manually by a vertical elongate hand lever 39 directed slightly rearwards. As a result of the to-and-fro pivoting movement of the hand lever 39, the hydraulic pump 38 conveys oil into the hydraulic cylinder 33 at the bottom, so that its piston rod 34 is extended upwards. The upward movement of the carrier rods 24, 25 takes place as a result.

In order to lower the carrier rods 24, 25, a hydraulic valve 40 is opened, so that the oil can run out of the hydraulic cylinder 33 into a reservoir. The piston rod 34 is thereby retracted, and the carrier rods 24, 25 are lowered. The hydraulic valve 40 is likewise adjustable by hand by means of a vertical elongate actuating rod 41.

In order to receive a reel 11, the transport appliance 10 is moved towards the reel 11, with the carrier rods 24, 25 lowered. In this case, the carrier rods 24, 25 are located approximately level with the longitudinal spars 19, 20. The relative position is selected in such a way that the carrier rods 24, 25 in the lower region of the vertically positioned reel 11 are moved past the cylindrical circumferential surface. The carrier rods 24, 25 are attached to the lower ends of vertical carrier arms 42, 43. These are in turn connected to the crosspiece 31. When received by the carrier rods 24, 25, the reel 11 comes to bear on the vertical carrier arms 42, 43. The reel is now in a stable position. The carrier mechanism together with the carrier rods 24, 25 can now be moved upwards, at the same time taking up the reel 11 resting on the carrier rods 24, 25.

The reel 11 is preferably moved to a height which corresponds to the position of the working journal 15 on the accepting packaging machine 14. In the exemplary embodiment shown, this position is defined by stops 44, 45 which limit the upward movement of the lifting frame. The stops 44, 45 are arranged on the vertical guide rods 28, 29. They can be vertically adjusted in a suitable way and fixed in the desired position. During the upward movement, the carrier bodies 26, 27 run up against the stops 44, 45. The position which results in this case is shown in FIG. 5.

After the reel 11 has been transferred onto the packaging machine 14, the lifting frame is lowered again to the lower position according to FIG. 2 as a result of the dead weight by the actuation of the hydraulic valve 40. The next reel can then be received.

Preferably a plurality of reels 11 rest on the pallet 12 vertically next to one another in the axial direction. After the first reel has been received and transported in the way described above, the reception of a further reel 11 from the same pallet 12 can then take place. According to the invention, the spacing of the longitudinal spars 19, 20 is greater than the width of the pallet 12. The transport appliance 10 can be moved in such a way that the longitudinal spars 19, 20 are arranged on both sides of the pallet 12. The transport appliance 10 has such great "ground clearance" that the raisable and lowerable carrier rods 24, 25 are located above the pallet 12 for the purpose of receiving the reel 11. The carrier rods 24, 25 extend between the longitudinal spars 19, 20 in the lower region of the cylindrical circumferential surface of the reel 11. The transport appliance 10 is moved towards the second reel 11 in the same way as has already occurred during the extraction of a first reel 11. The subsequent procedure with the second reel 11 is the same as with the first. By adapting the dimension of the transport appliance 10 to the dimensions of the pallet 12, up to five reels 11 can be extracted singly or in groups in succession from the same pallet 12 and delivered to a processing machine.

In order to stabilize the vertical carrier members, especially the guide rods 28, 29, two parallel vertical supporting rods 46, 47 are provided. Whilst the guide rods 28, 29 are connected to the front transverse spar 22, the supporting rods 46, 47 extend in the region of the rear transverse spar 21. The guide rods 28, 29, on the one hand, and the supporting rods 46, 47, on the other hand, are connected to one another in the longitudinal and transverse direction by means of the cross-member 36 arranged between the abovementioned rods.

The storage of the reels 11 takes place on pallets 12. A plurality of stays 58 are arranged in three rows on the underside of these. The rows of stays 58 arranged spaced from one another on both sides and in the middle of the pallet 12 extend parallel to one another in the longitudinal direction of the pallet 12. The stays 58 of a row are connected to one another in their underside by means of a flat profile 59.

The design shown as a detail in FIG. 6 differs from conventional pallets 12 in supporting members for the reels 11 on the top side. These are elongate supporting battens 49, 50. They are of trapezoidal design in cross-section. This results in descending supporting surfaces 51, 52 inclined towards the middle of the pallet 12. The spacings of the supporting battens 49, 50 and the inclination of the supporting surfaces 51, 52 are selected in such a way that the reels 11 rest positively with the cylindrical circumferential surface on the supporting surfaces 51, 52 (FIG. 3). In particular, the dimensions are coordinated with one another in such a way that the reels 11 rest additionally with their lower middle region on a bearing surface 53 of the pallet 12, so that support is provided in three regions.

The supporting battens 49, 50 are arranged in such a way that the empty pallets 12 can be stacked in a space-saving manner, the supporting battens 49, 50 lying between central and lateral rows of stays 58 of the pallets 12. The height of the stays 58 together with the flat profile 59 fastened to the underside is altogether slightly smaller than the height of the supporting battens 49, 50. An upper pallet 12 therefore rests on the two supporting battens 49, 50 of a lower pallet 12.

The transport appliance 10 is coordinated with the dimensions of the pallets 12. The spacing of the longitudinal spars 19, 20 is selected in such a way that these can be moved in on both sides of the pallet 12 (FIG. 3). At the same time, measures for an exact central position of the transport appliance 10 relative to the pallet 12 are provided. These are guide rails 54, 55 which are attached to the inside of the longitudinal spars 19, 20, specifically level with the pallet 12 or lateral limitations of the latter. The guide rails 54, 55 can slide along on the side faces of the pallets 12 in an adjusting manner.

In order to guarantee an exact positioning of the transport appliance 10 relative to the pallet 12 or to the reel 11, the running rollers 18 at the front in the direction of movement can be locked in terms of steerability. For this purpose, an outward-projecting extension 56 is attached to the bogie for the front running rollers 18. This extension 56 can be secured by means of a bolt 57 operable by hand, so that the running rollers 18 are fixed in the position directed straight ahead. In this position, only the rear running rollers 17 can rotate about a vertical axis with a steering effect.

Instead of the carrier rods 24, 25 for grasping the reel 11 on the circumference, a carrier journal, which grasps the reel 11 to be transported in the region of the orifice 13, can also be attached to the lifting mechanism 23.

We claim:

1. Apparatus for the reception of at least one reel (11) of wound packaging material and for the transport of said at least one reel (11) to a processing device (14), said apparatus comprising:

a transportation device (10), said transportation device (10) comprising:

an undercarriage (16), said undercarriage (16) having a U-shape when viewed from a location above said undercarriage (16), said undercarriage (16) comprising:

lateral longitudinal spars (19, 20); and an eccentrically arranged transverse connection between said longitudinal spars (19, 20), said transverse connection comprising at least one transverse spar (21, 22);

running rollers (17, 18) arranged on said longitudinal spars (19, 20) for the mobility of the transportation device (10); and two carrier rods (24, 25) for receiving said at least one reel (11), said two carrier rods (24, 25) being movable up and down and being arranged on said undercarriage (16); and a pallet (12) configured as a support for said at least one reel (11), said pallet (12) having an upper side, parallel supporting battens (49, 50) being arranged on said upper side, said battens (49, 50) extending in a longitudinal direction of said pallet (12), said supporting battens (49, 50) being adapted to support said at least one reel (11) on a circumferential surface of said at least one reel (11);

wherein said carrier rods (24, 25) are adapted to grasp and raise said at least one reel (11) resting in a vertical plane with essentially horizontally directed axis on said pallet (12), said at least one transverse spar (21, 22) being dimensioned such that the spacing of the longitudinal spars (19, 20) is greater than a transverse dimension of the pallet (12), and guide rails (54, 55) are attached to said longitudinal spars (19, 20), each of said guide rails (54, 55) extending substantially parallel to one of said longitudinal spars (19, 20), said guide rails (54, 55) being spaced at a distance from one another corresponding approximately to said transverse dimension of the pallet (12), whereby said guide rails (54, 55) respectively abut a first and a second longitudinal side of the pallet (12) in a centering manner during said grasping and raising of said at least one reel (11) resting on said pallet (12).

2. Apparatus according to claim 1, further comprising:

vertical carrier arms (42, 43), each one of said carrier rods (24, 25) being arranged at a lower end of one of said vertical carrier arms (42, 43);

a crosspiece (31) connecting said vertical carrier arms (42, 43) in an upper region of said vertical carrier arms (42, 43); and carrier bodies (26, 27) to which said crosspiece (31) is attached.

3. Apparatus according to claim 2, further comprising:

vertical guide rods (28, 29) on which the carrier bodies (26, 27) and carrier rods (24, 25) are movable up and down jointly as a unit; and an hydraulic assembly (32) for moving the carrier rods (24, 25) up and down, said hydraulic assembly (32) being arranged on said at least one transverse spar (21, 22).

4. Apparatus according to claim 1, characterized in that the pallet (12) is provided with bearing surfaces (53) and the supporting battens (49, 50) are provided with inclined supporting surfaces (51, 52), said bearing surfaces (53) and said supporting battens (49, 50) being adapted to support the at least one reel (11) on its circumferential surface, and in that the spacings of the supporting battens (49, 50) and the inclination of the inclined supporting surfaces (51, 52) of the supporting battens (49, 50) are coordinated with one another in such a way that the at least one reel (11) can rest additionally with its lower central region on the bearing surfaces (53) of the pallet (12).

5. Apparatus according to claim 4, characterized in that said carrier rods (24, 25) are spaced at a distance from one another that is greater than a distance between respective outer sides of said supporting battens (49, 50), whereby said carrier rods (24, 25) extend along said respective outer sides of said supporting battens (49, 50) during said grasping of said at least one reel (11), said carrier rods (24, 25) being spaced at a distance from one another less than said transverse dimension of the pallet (12).

6. Apparatus according to claim 1, characterized in that stays (58) are arranged on an underside of the pallet (12) in three rows extending parallel to one another, respective rows of the three rows extending in the longitudinal direction of the pallet (12) on said first and said second longitudinal side of the pallet (12) and in the longitudinal direction of the pallet (12) in a middle of the pallet (12) substantially equidistant from the first and second longitudinal sides of the pallet (12), respective battens of the supporting battens (49, 50) lying between the row of the three rows in the middle of the pallet (12) and a respective row of the three rows on either the first or second longitudinal sides of the pallet (12).

* * * * *